US006622949B1

(12) United States Patent
Baswick et al.

(10) Patent No.: US 6,622,949 B1
(45) Date of Patent: Sep. 23, 2003

(54) PORTABLE, SOLENOID DRIVEN, MEDICINE CRUSHER

(76) Inventors: Gloria Baswick, P.O. Box 222, Didsbury, Alberta (CA), T0M 0W0; John Baswick, P.O. Box 222, Didsbury, Alberta (CA), T0M 0W0

( * ) Notice: Subject to any disclaimer, the term of this patent is extended or adjusted under 35 U.S.C. 154(b) by 0 days.

(21) Appl. No.: 10/193,587

(22) Filed: Jul. 10, 2002

(51) Int. Cl.[7] ..... B02C 19/08
(52) U.S. Cl. ..... 241/36; 241/DIG. 27
(58) Field of Search ..... 241/27, 30, 36, 241/100, 168, 169, 169.2, DIG. 27

(56) References Cited

U.S. PATENT DOCUMENTS

| | | | | |
|---|---|---|---|---|
| 2,892,595 | A | 6/1959 | Tupper | |
| 3,915,393 | A | * 10/1975 | Elkins | 241/168 |
| 4,121,775 | A | 10/1978 | Roseberg et al. | |
| 4,212,430 | A | 7/1980 | Dale et al. | |
| 4,366,930 | A | 1/1983 | Trombetti, Jr. | |
| D285,966 | S | 9/1986 | Porter | |
| 4,924,636 | A | 5/1990 | Hoffman | |
| 4,967,971 | A | 11/1990 | Smith | |
| 5,025,996 | A | 6/1991 | Lavin et al. | |
| 5,067,666 | A | 11/1991 | Sussman | |
| 5,123,601 | A | 6/1992 | Lavin et al. | |
| 5,178,337 | A | 1/1993 | Lupoli | |
| D337,828 | S | 7/1993 | Gordon | |
| 5,248,102 | A | * 9/1993 | Bohn | 241/99 |
| 5,376,072 | A | 12/1994 | Klearman et al. | |
| 5,464,393 | A | 11/1995 | Klearman et al. | |
| 5,531,386 | A | 7/1996 | Jensen | |
| 5,618,004 | A | * 4/1997 | Klearman et al. | 241/21 |
| 5,863,001 | A | 1/1999 | Schulze | |
| D405,889 | S | 2/1999 | Parsons | |
| 5,915,637 | A | 6/1999 | Parsons | |
| 6,059,209 | A | 5/2000 | Barson | |
| 6,508,424 | B1 | * 1/2003 | Marshall | 241/169.1 |

* cited by examiner

*Primary Examiner*—Mark Rosenbaum
(74) *Attorney, Agent, or Firm*—Gene Scott-Patent Law & Venture Group

(57) ABSTRACT

A solid medicine crushing apparatus comprises: a solenoid mounted within an enclosure wherein the solenoid engages a crushing ram in an attitude for moving vertically downward when the solenoid is energized. A return spring engaged with the ram moves the ram to a starting position when the solenoid is deenergized. A cup assembly is used for holding a medicine to be crushed. The cup assembly includes an outer cup and an inner cup, where the outer and the inner cups are joined with a living hinge such that the inner cup is able to be rotated from a side-by-side position with the outer cup, to a position within the outer cup. A medicine is placed in the outer cup, the inner cup is then rotated into the outer cup to sandwich the medicine between the outer cup and the inner cup. The cups with the medicine are placed into the enclosure which is sealed by closing an interlocked door of the enclosure. The solenoid is then energized to bring the crushing ram into contact with the inner cup to crush the medicine.

3 Claims, 1 Drawing Sheet

PORTABLE, SOLENOID DRIVEN, MEDICINE CRUSHER

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to mechanical crushing machines and more particularly to a portable medicament crusher.

2. Description of Related Art

The following art defines the present state of this field:

Porter, U.S. Pat. No. Des. 285,966 describes a pill crusher design.

Gordon, U.S. Pat. No. Des. 337,828 describes a pill crusher design.

Parsons, U.S. Pat. No. Des. 405,889 describes a pill crusher apparatus design.

Tupper, U.S. Pat. No. 2,892,595 describes a portable storage and crushing device comprising a pair of hollow and openmouthed and conically-shaped interfitting resilient vessels, the inner vessel inner wall affording a storage chamber, an annular bead on the inner vessel outer wall movably and rotatably engagable with the outer vessel inner wall for spacing said walls for the formation of a crushing chamber and for initially crushing materials therebetween by downward and rotary pressure on the inner vessel, the outer vessel inner wall having an annular groove for rotatable interfitting and latching engagement with said bead upon further descent of the inner vessel after reduction in size of the crushing chamber for final comminution and for latching the vessels together.

Roseburg et al., U.S. Pat. No. 4,121,775 describes a pulverizer generally including a bowl for receiving an object to be pulverized and a pestle movable into the bowl for pulverizing the object. This system has been improved by providing a container, which has a depression similar in shape to the shape of the bowl, which is received in the bowl and the object is pulverized in the depression of the container to prevent the pulverized material from contaminating the bowl. The container has a flap for covering the depression to hold the pulverized material in the depression. The flap is folded over the depression and locked by a suitable locking mechanism. The pestle has a generally convex but truncated downwardly facing surface, which generally conforms to the upper surface of the bowl over the major portion of the exterior, and the bottom surface of the pestle is spaced from the bottom surface of the bowl when the pestle is mated in the bowl. A projection extends from the bottom of the pestle for localizing forces from the pestle for initially cracking hard objects, and the projection extends to the bottom surface of the bowl when the major portion of the pestle contacts the upper surface of the bowl. The pestle is rotated by a motor and it is mounted on a support, which permits the pestle to be angled in the bowl.

Dale et al, U.S. Pat. No. 4,212,430 describes a hand-held pulverizer, which is compact and efficient to use to pulverize or grind a material. A cover is removably attached to a hollow cylindrical casing containing a mesh screen. A grinder disc is securely affixed to one end of a shaft rotatably mounted in the cover and is in frictional contact with the mesh screen. A handle attached to the shaft above the cover permits the shaft and disc to be rotated, grinding or pulverizing the material placed on the screen beneath the disc. A collecting plate attached to the bottom of the cylindrical casing receives the pulverized material falling through the screen.

Trombetti, Jr., U.S. Pat. No. 4,366,930 describes a table pulverizer for crushing solid tablets into powder. The tablet pulverizer is hand-operated and includes a tubular body portion having a screen located therein for receiving the solid tablets thereon. An elongated axially movable crusher member extends into the body portion and is axially and rotatably movable to crush the solid tablets into powder form. A bottom container that is mounted on the tubular body portion at the lower end thereof receives the powder as it is filtered through the screen, the container being removable from the body portion for dispensing of the powder as required.

Hoffman, U.S. Pat. No. 4,924,636 describes a locking member is formed with a circular plate and an upstanding rim and is adapted to be pivoted between locked and unlocked positions beneath the head of an orbital sander. When in its locked position, the locking member holds the spindle of the sander against turning and permits the sanding pad to be unscrewed from the spindle. The plate of the locking member includes a dimple, which engages the head and causes the locking member to rotate concentrically with the head when the locking member is in its normal, unlocked position. The rim of the locking member performs a fail-safe holding function in the event the dimple fails and also prevents the locking member from being improperly installed in an upside down position.

Smith, U.S. Pat. No. 4,967,971 describes a pestle and mortar for crushing pills in pill cups and is tailored to conform to the shape of a pill cup. A conventional frustum-shaped pill cup lines a frustum-shaped receptacle in the mortar to receive a frustum-shaped pill-crushing portion of the pestle, which is nestable in the pill cup. The frustum-shaped crushing portions of the pestle and mortar distribute pressure over much of the exterior and interior surface areas of a pill cup so that pills may be crushed in eve n fragile paper pill cups without tearing or otherwise damaging the paper pill cups. Moreover, the pill cup and mortar operate as one piece and the frustum-shaped crushing portion of the pestle substantially seals the interior of the pill cup to prevent pill granules from flying out of the pill cup during a pill crushing operation.

Lavin et al., U.S. Pat. No. 5,025,996 describes a tablet pulverizer for crushing a pill or tablet, wherein the pulverizer includes a convex arm and concave arm. The concave arm has a smooth, arcuate crushing surface which nests with a smooth, convex crushing surface on the convex arm. The meshing of these smooth, arcuate, nesting arms provide a substantial crushing surface to be applied to the pill or tablet for crushing the same without damaging the pill container.

Sussman, U.S. Pat. No. 5,067,666 describes a portable device for pulverizing pills, tablets and the like to form a minute substantially uniform powder therefrom. The device includes a cam-driven spring biased ram, which reciprocates once on a vertical axis into and out of engagement with a pill disposed therebeneath with sufficient localized force to pulverize the pill. A microswitch interrupts power to the device until it senses that the pill is correctly disposed axially beneath the ram.

Lavin et al., U.S. Pat. No. 5,123,601 describes a tablet pulverizer for crushing a pill or tablet, wherein the pulverizer includes a convex arm and concave arm. The concave arm has a smooth, arcuate crushing surface which nests with a smooth, convex crushing surface on the convex arm. The meshing of these smooth, arcuate, nesting arms provide a substantial crushing surface to be applied to the pill or tablet for crushing the same without damaging the pill container.

Lupoli, U.S. Pat. No. 5,178,337 describes a pill crusher having a pair of pivoted handles each including a serrated jaw for crushing pills therebetween. Each jaw includes a handle-engaging portion substantially perpendicular to the jaw surface. The serrated jaw surfaces extend outwardly from the handles and have a convex curved outer perimeter for resting against a hand receiving a crushed pill. The device has finger-retaining rings and is opened and closed similarly to scissors.

Klearman et al., U.S. Pat. No. 5,376,072 describes a pill-crushing syringe including a barrel and a plunger, with abraded surfaces on each so that a pill placed in the barrel is crushed as the plunger advances within the barrel. The barrel has an aperture located near the closed end with a catheter connected around and extending from the aperture. The plunger has a sealing gland to provide an airtight seal with the barrel so that liquid may be drawn into the barrel through the aperture by withdrawing the plunger from the barrel to thereby suspend the crushed pill in the liquid, and the suspension may be flushed from the barrel by thereafter advancing the plunger into the barrel.

Klearman et al., U.S. Pat. No. 5,464,393 describes a pill-crushing syringe, which includes a barrel and a plunger, with abraded surfaces on each so that a pill placed in the barrel is crushed as the plunger advances within the barrel. The barrel has an aperture located near the closed end with a catheter connected around and extending from the aperture. The plunger has a sealing gland to provide an airtight seal with the barrel so that liquid may be drawn into the barrel through the aperture by withdrawing the plunger from the barrel to thereby suspend the crushed pill in the liquid, and the suspension may be flushed from the barrel by thereafter advancing the plunger into the barrel. In an alternative embodiment, a bi-level barrel has an aperture in spaced relation to the closed end, forming a pocket wherein the crushed pill ingredients accumulate. The pocket at the closed end and the separation between the aperture and the barrel-closed end helps prevent the medication from escaping the barrel via the catheter prior to aspiration. In still other embodiments, the syringe has a side entry plunger or two opposing plungers.

Jensen, U.S. Pat. No. 5,531,386 describes a device for crushing medicaments originally formed in pill of tablet contour into a fine powder. An impact device moves from a first energy stored position latched there against spring pressure awaiting tripping of the latch or cam by the pill which has been ensconced in a container embodied as an envelope. The envelope is placed in a slot and oriented to trigger a switch, which releases from a captive position the hammer. The hammer advances linearly impacting against an anvil upon which the envelope and the enclosed pill awaits. The explosive force of the hammer creates a powder substance because of the explosive nature of the hammer's contact against the anvil. While the hammer is being withdrawn under motor drive, the envelope may be removed for access to the interior contents for subsequent dispensation.

Schulze, U.S. Pat. No. 5,863,001 describes a method and apparatus for crushing various items such as medicinal pills, foods, including garlic, and the like, wherein a biased force is applied between an item in a pocket and a boss conforming to the interior configuration of the pocket resulting in a gradual crushing of the product.

Parsons, U.S. Pat. No. 5,915,637 describes a pill crusher having an elongated base, an anvil integrally fixed to the base, a movable handle and a compression link, pivotally coupled to the base and pivotally connected to the handle, for facilitating rotational movement of the handle relative to the base. A platen is coupled pivotally to an anchor block on the base and connected at the other end to the handle so that movement of the handle produces movement of the platen relative to the anvil, for crushing a pill between the two. A pouch is provided, for receiving a pill to be crushed. It is adapted to fit in a mouth defined by the anvil and the platen. The pill crusher includes a cover fixed to the base and disposed above the rear anchor block, the cover providing an onboard dispenser for a plurality of pouches.

Barson, U.S. Pat. No. 6,059,209 describes a pill crusher with a pivotable hammer, which applies pressure to the tablets when a press applies pressure to the hammer enabling a user to quickly and securely crush tablets. The hammer and the press are pivotally connected to opposing ends of a body, which has a crushing recess. Tablets are sandwiched between cups, which are disposed in a crushing bowl. The crushing bowl is rotatably and removably located in the crushing recess. The hammer has a crushing head configured to be pivoted into the rotatable crushing bowl. The crushing head has a crushing surface configured with a pattern of alternating recessed portions and raised portions. The press is eccentrically connected and a lever which extends eccentrically from the press.

The prior art teaches manual, spring and motor driven pill crushers, but does not teach a portable solenoid driven crusher, which is therefore efficient and light weight. The present invention fulfills this need and provides further related advantages as described in the following summary.

SUMMARY OF THE INVENTION

The present invention teaches certain benefits in construction and use which give rise to the objectives described below.

This invention is distinguished over the known prior art in a multiplicity of ways. This invention does not require the application of any manual force or other physical or strenuous activity to achieve the crushing process. This invention is unique in its limited number of operational and moving parts, essentially one, primary of which is an electric solenoid which crushes the medicament to a consistency appropriate for mixing with liquids for ease of swallowing.

Cleaning is unnecessary, because of the specially designed cup sandwich, which forms part of this patent, The rustproof, corrosion Proof ram that contacts the sandwich cup is smooth, forgoing the possibility of particles becoming stuck; and cross contamination.

Utilizes a special cup sandwich, which forms part of this patent application. This special cup is a one piece double cup, hinged so that one cup fits inside the other, sandwiching the medicaments between them, thus protecting the ram from contacting the medication and preventing some of the crushed material from becoming airborne.

A solid medicine crushing apparatus comprises: a solenoid mounted within an enclosure, wherein the solenoid engages a crushing ram in an attitude for moving vertically downward when the solenoid is energized. A return spring engaged with the ram moves the ram to a starting position when the solenoid is deenergized. A cup assembly is used for holding a medicine to be crushed. The cup assembly includes an outer cup and an inner cup, where the outer and the inner cups are joined with a living hinge such that the inner cup is able to be rotated from a side-by-side position with the outer cup, to a position within the outer cup. A medicine is placed in the outer cup, the inner cup is then rotated into the outer cup to sandwich the medicine between the outer cup and the inner cup. The cups with the medicine are placed into the enclosure which is sealed by closing an interlocked door of the enclosure. The solenoid is then energized to bring the crushing ram into contact with the inner cup to crush the medicine.

A primary objective of the present invention is to provide an apparatus and method of use of such apparatus that provides advantages not taught by the prior art.

Another objective is to provide such an invention capable of crushing medicines without manual work.

A further objective is to provide such an invention capable of crushing medicines in a manner wherein all portions of the crushed medicine are retrieved.

A still further objective is to provide such an invention capable of small size, portable power, rechargeable and safe to use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
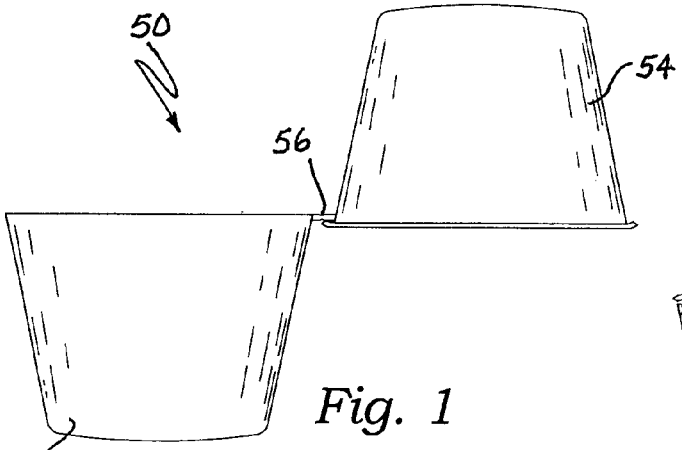
FIG. 1 is a side elevational view of a cup assembly of the invention showing the cups in a disengaged attitude.

The present invention is a pill crushing apparatus comprising: a solenoid 10 mounted within an enclosure 20, where the solenoid 10 engages a crushing ram 30 in an attitude for moving vertically downward when the solenoid 10 is energized by pressing start button 15. A return spring 40 engages the ram 30 for moving it to an upwardly starting position, shown in FIG. 3, when the solenoid 10 is deenergized. A cup assembly 50 is used for holding a medicine 50' to be crushed. The cup assembly 50, includes an outer cup 52 and an inner cup 54, the outer and the inner cups joined with an integral hinge 56 such that the inner cup 54 is able to be rotated from a side-by-side position with respect to the outer cup 52, shown in FIG. 1, to a position within the outer cup 52, shown in FIG. 2. Preferably, the cups 52, 54 and the hinge 56 are molded as a single integral part, with the hinge 56 preferably of the same material as the cups. A recess 90 in the enclosure 20 is positioned for receiving the cup assembly 50 immediately below a crushing ram head 32 so that the cup assembly 50 is centered thereunder.

Figure 3:
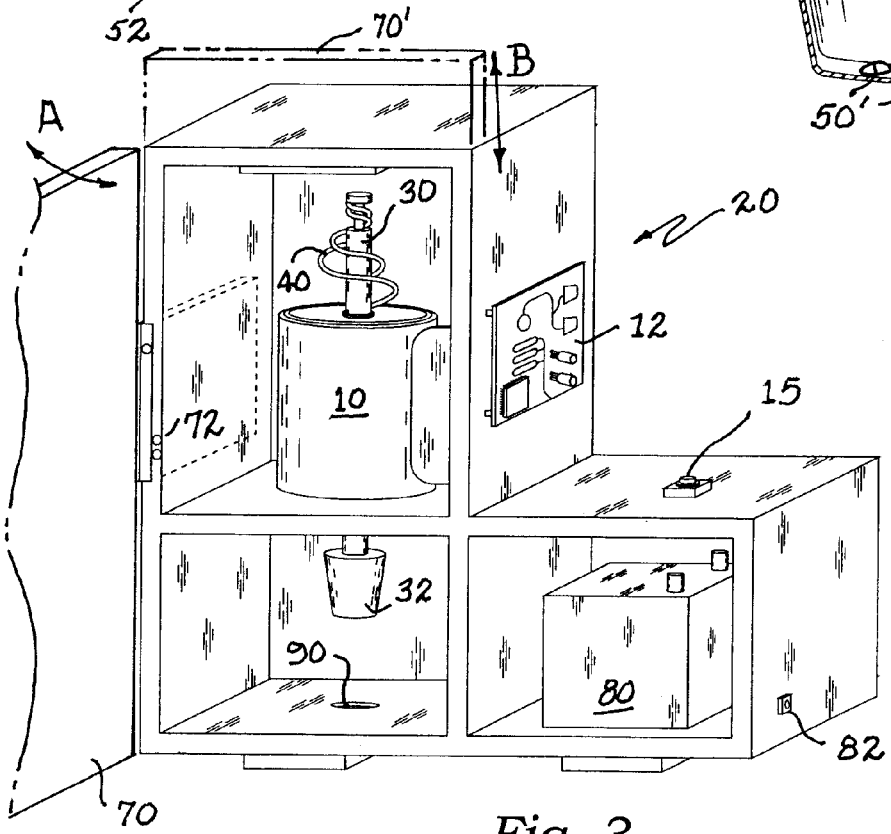
FIG. 3 is a perspective view of the preferred embodiment of a crushing machine of the invention.

The enclosure has a door 70 positioned for sealing the enclosure 20, and a door switch 72 interconnected with the door so as to break a solenoid circuit 12 when the door 70 is in an open position as shown in FIG. 3. This is a safety feature, which prevents the ram head 32 from moving when the door is open. Door interlocks for safety reasons is so well known in the art that one of average skill would know how to enable such. The door may hinge to the side, as shown in FIG. 3 as numeral 70 and arrow 'A,' or it may, alternately, be engaged for moving vertically, as shown by numeral 70' and arrow 'B', and the method of mounting and actuating such doors, whether opening to one side or vertically is very well known in the art. This is a safety feature, which prevents the ram head 32 from moving when the door is open.

A portable power supply 80, such as a battery, is enabled for receiving an electrical charge through a built-in connector 82, as is well known in the art.

Figure 2:
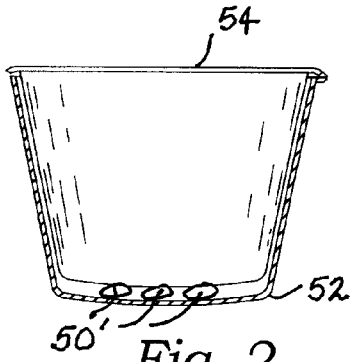
FIG. 2 is a side elevational view of the cup assembly of the invention showing the cups in an engaged attitude with an outer cup shown in section and with medicine capsules shown sandwiched between the cups.

The above described apparatus is used for crushing a medicine 50' in the following manner. A medicine 50', shown in FIG. 2, is placed in the bottom of the outer cup 52; the inner cup 54 is rotated into the outer cup 52 to sandwich the medicine 50' between the outer cup and the inner cup as shown in FIG. 2; the cups with the medicine are placed into the enclosure 20 in depression 90. The interlocked door 70 of the enclosure 20 is closed to seal the enclosure 20 and the solenoid 10 within the enclosure is energized using switch 15, to bring the crushing ram head 32 into contact with the bottom surface of the inner cup 54 to crush the medicine. Upon completion, the ram 30 is automatically returned to its starting upward position by spring 40, and the door 70 is enabled to be opened by circuit 12.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A pill crushing apparatus comprising: a solenoid mounted within an enclosure; the solenoid engaging a crushing ram movable downwardly when the solenoid is energized; a return spring engaged with the crushing ram for moving the crushing ram upward when the solenoid is deenergized; and a cup assembly holding a medicine to be crushed, the cup assembly including an outer cup and an inner cup, the outer and the inner cups joined with an integral hinge, the hinge positioned for enabling movement of the inner cup between side-by-side and cup-within-cup alternate cup positions.

2. The apparatus of claim 1 wherein the enclosure further comprises a door sealing the enclosure, and a door switch interconnected with the door for enabling and disabling the solenoid circuit with door position.

3. The apparatus of claim 1 further comprising a recess in the enclosure for receiving the cup assembly, the recess positioned below the crushing ram.

* * * * *